US005857942A

United States Patent [19]

Moon et al.

[11] Patent Number: 5,857,942

[45] Date of Patent: Jan. 12, 1999

[54] TREADMILL

[75] Inventors: Dan Moon, Riverview, Ill.; Stanley J. Goldfader, St. Louis, Mo.; David Green, St. Charles, Mo.; Frank R. Trulaske, St. Louis, Mo.; Scott Eyler, St. Peters, Mo.

[73] Assignee: True Fitness Technology, Inc., O'Fallon, Mo.

[21] Appl. No.: 910,605

[22] Filed: Aug. 13, 1997

[51] Int. Cl.[6] ..... A63B 22/02

[52] U.S. Cl. ..... 482/54; 482/51

[58] Field of Search ..... 422/51, 54, 70, 422/71; D21/192

[56] References Cited

U.S. PATENT DOCUMENTS 5,282,776 2/1994 Dalebout ..... 482/54

OTHER PUBLICATIONS

Taiwan Sports Goods Buyer's Guide '95, selected pages, 1995.

*Primary Examiner*—Lynne A. Reichard

*Attorney, Agent, or Firm*—Howell & Haferkamp, L.C.

[57] ABSTRACT

A treadmill comprises a base, a pair of spaced rollers, an endless belt, a control panel, and a forward post. The rollers are journalled in the base. One of the rollers constitutes a rear roller and the other roller constitutes a forward roller spaced forward of the rear roller. The belt is entrained around the rollers. The belt includes an upper reach extending between the rollers and adapted to enable a user to walk or run thereon. The forward post is configured for at least in part supporting the control panel. The post has a lower end margin and an upper end margin The lower end margin is operatively connected to the base and is spaced forward of the forward roller. The upper end margin of the post is configured for supporting the control panel. The post has an arcuately shaped bend extending from its lower end margin to its upper end margin. The bend of the post has a concave surface portion facing generally rearwardly and extending from the lower end margin of the post to the upper end margin of the post.

18 Claims, 5 Drawing Sheets

TREADMILL

BACKGROUND OF THE INVENTION

This invention relates to treadmills.

A typical treadmill generally has a base, a pair of parallel, spaced rollers journalled in the base, and an endless belt entrained around the rollers. An upper reach of the belt extends between the rollers. One of the rollers is powered by a suitable motor to rotate the roller, thereby moving the belt with the rollers. The moving upper reach provides a running/walking surface upon which a user may walk or run. A forward post extends up from the base for supporting a control panel. The control panel typically has controls for turning the treadmill on and off and for varying the speed of the belt. The control panel also often has indicators for selectively displaying operational information such as speed, distance traveled, time, etc. The user may press a suitable button on the control panel to toggle between two or more different displays.

A disadvantage of conventional treadmills is that users wishing to access the control panel must run or walk on the forward-most portion of the upper reach. If the user's foot inadvertently strikes the stationary base while the user is walking or running on the upper reach, then the user may lose his or her balance.

SUMMARY OF THE INVENTION

Among the several objects of the present invention may be noted the provision of an improved treadmill; the provision of such a treadmill having a control panel positioned in such a manner as to minimize the likelihood of a user's foot striking a forward part of the treadmill's stationary base; the provision of such a treadmill which is aesthetically pleasing; and the provision of such a treadmill which is of relatively simple and elegant construction.

In general, a treadmill of the present invention comprises a base, a pair of spaced rollers, an endless belt, a control panel, and a forward post. The rollers are journalled in the base. One of the rollers constitutes a rear roller and the other roller constitutes a forward roller spaced forward of the rear roller. The belt is entrained around the rollers. The belt includes an upper reach extending between the rollers and adapted to enable a user to walk or run thereon. The forward post is configured for at least in part supporting the control panel. The post has a lower end margin and an upper end margin. The lower end margin is operatively connected to the base and is spaced forward of the forward roller. The upper end margin of the post is configured for supporting the control panel. The post has an arcuately shaped bend extending from its lower end margin to its upper end margin. The bend of the post has a concave surface portion facing generally rearwardly and extending from the lower end margin of the post to the upper end margin of the post.

In another aspect of the present invention, a treadmill includes a handle bar having an upper portion and first and second side portions. The upper portion is positioned above the upper reach of the endless belt. The side portions extend from the upper portion to the base and have lower ends operatively connected to the base on opposite sides of the upper reach and generally between the forward and rear rollers (i.e., forward of the rear roller and rearward of the forward roller). Each side portion of the handle bar has an arcuately shaped bend extending at least three-fourths of the length of such side portion.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 6:
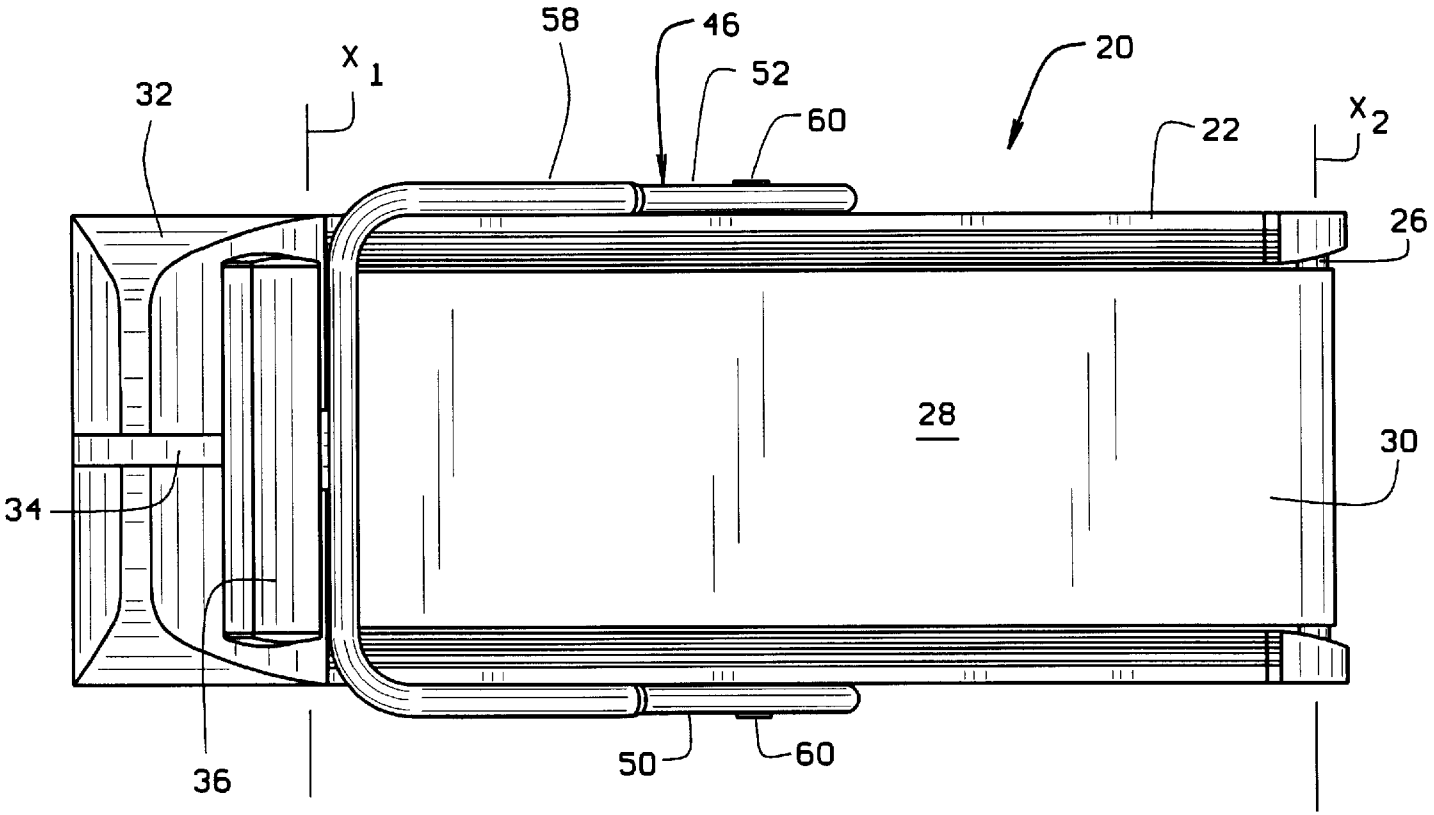
FIG. 6 is a top plan view of the treadmill of FIG. 1.

Referring now to the drawing, a treadmill of the present invention is indicated in its entirety by the reference numeral 20. The treadmill includes a stationary base, generally indicated at 22, a forward roller 24 (FIG. 1), a rear roller 26, an endless belt 28, and a support deck (not shown). The support deck is supported by the stationary base 22 in a generally horizontal position. The forward and rear rollers 24, 26 are journalled in the base 22 for rotation about parallel forward and rear axes $X_1$, $X_2$ (FIG. 6). The forward roller 24 is spaced slightly forward of the support deck and the rear roller 26 is spaced slightly rearward of the support deck. The endless belt 28 surrounds the support deck and is entrained around the rollers 24, 26. An upper reach 30 of the belt 28 extends between the rollers 24, 26 and over the support deck. The upper reach 30 is the surface upon which a user walks or runs. The forward roller 24 is rotated by a suitable motor (not shown) preferably positioned forward of the forward roller to rotate the belt in a manner to cause the upper reach to move rearwardly. The motor is preferably covered by a motor shroud 32 positioned forward of the forward roller.

Figure 1:
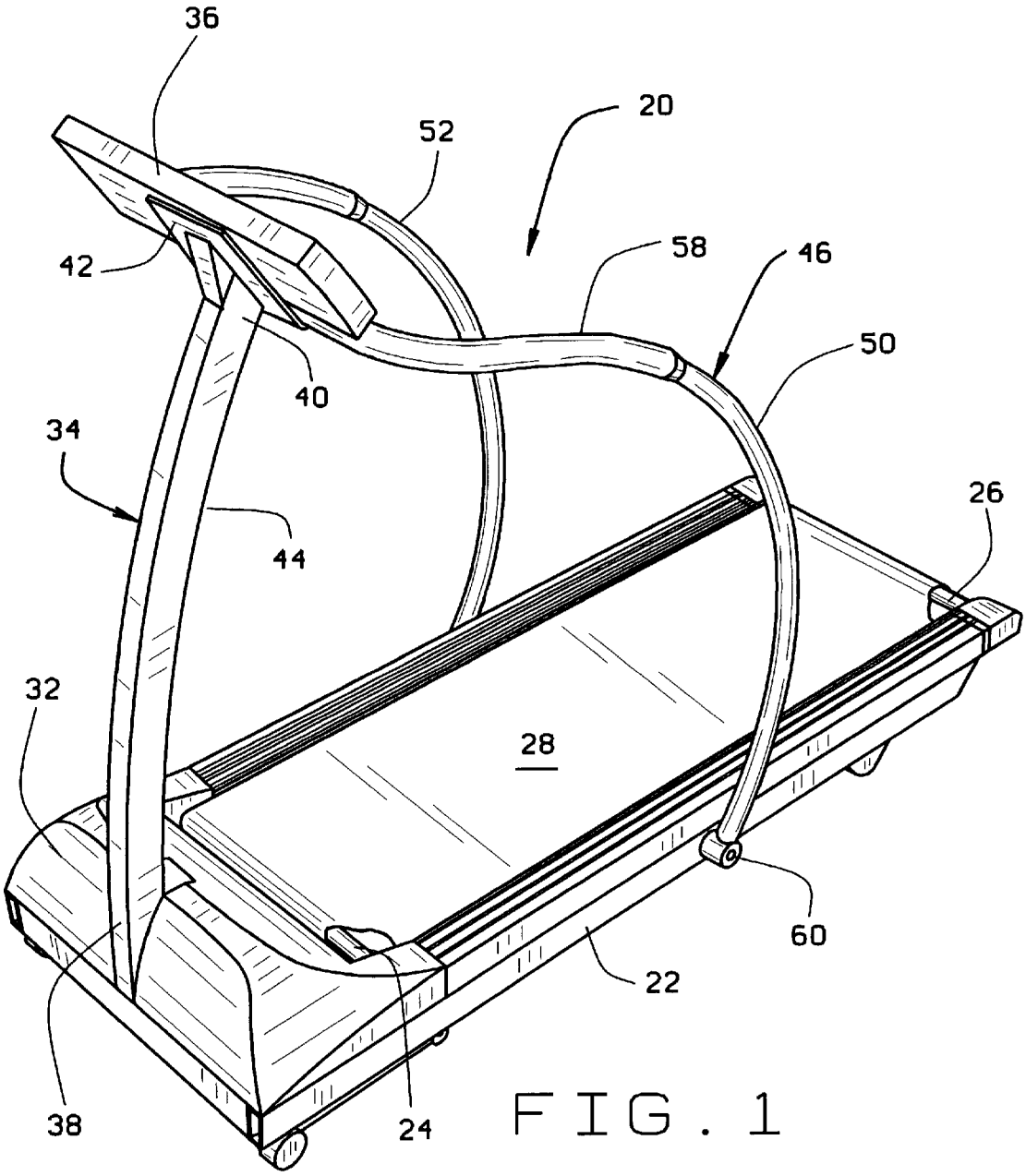
FIG. 1 is a perspective view of a treadmill of the present invention with portions broken away to show detail.
Figure 2:
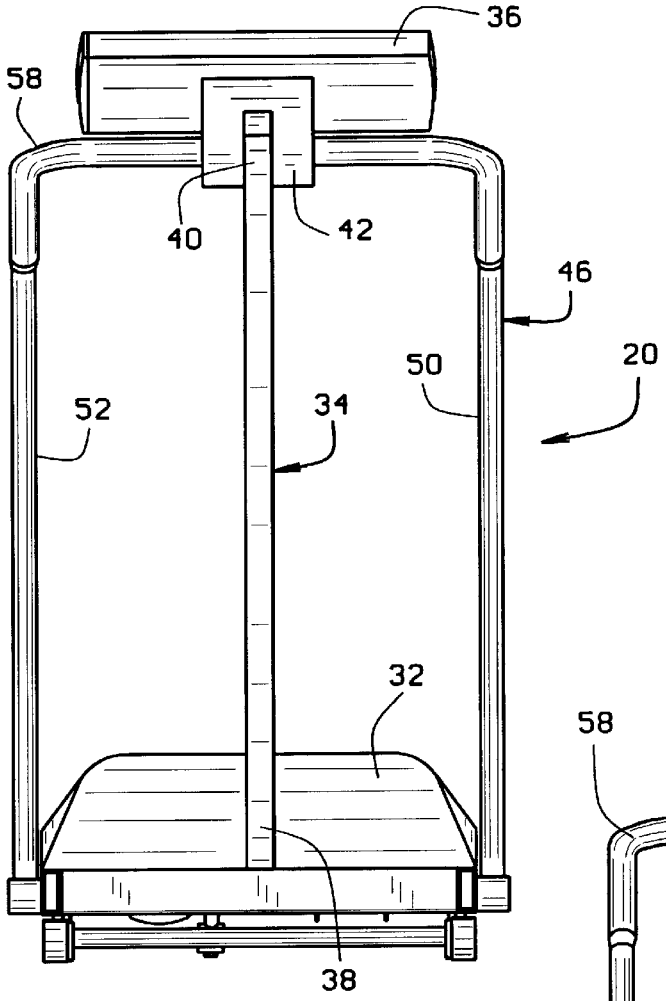
FIG. 2 is a rear elevational view of the treadmill of FIG. 1.
Figure 4:
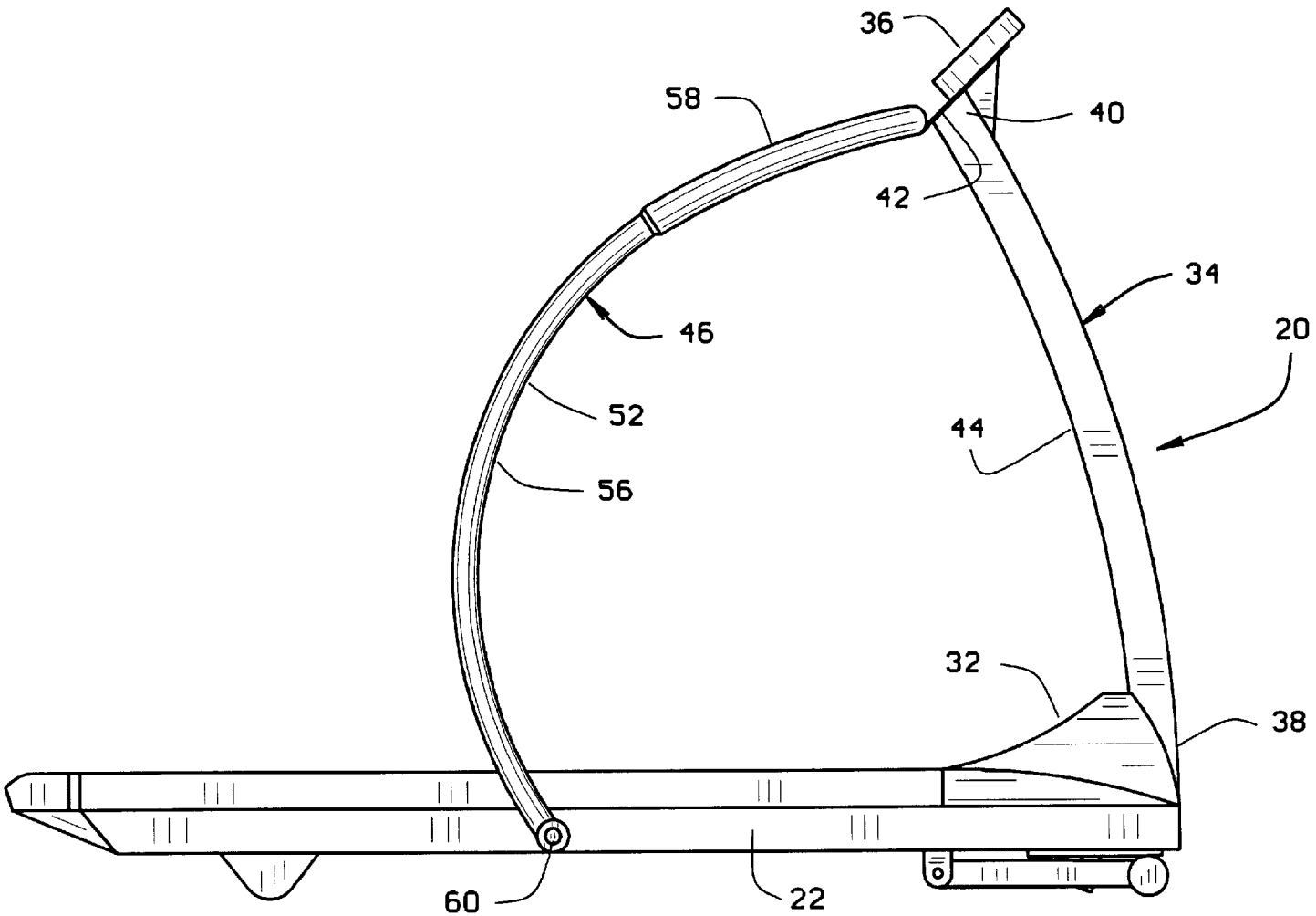
FIG. 4 is a right side elevational view of the treadmill of FIG. 1.
Figure 5:
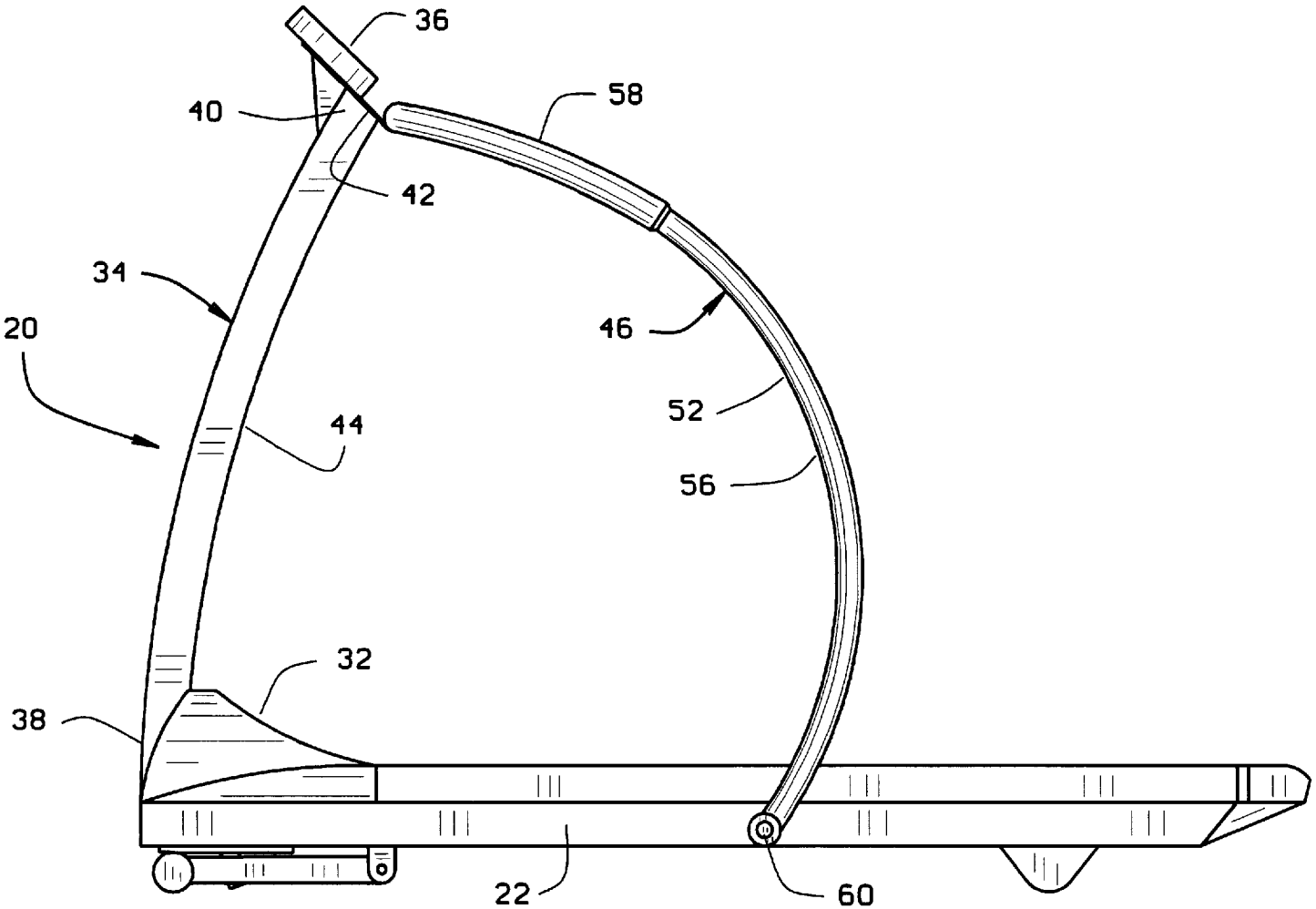
FIG. 5 is a left side elevational view of the treadmill of FIG. 1.

A forward post, generally indicated at 34, extends up from the stationary base 22 for supporting a control panel 36. The control panel 36 is preferably a conventional control panel having controls for controlling and monitoring several of the treadmill's functions. To simplify the drawings, the control panel 36 is shown schematically without controls and indicators. However, it is to be understood that the control panel actually has conventional controls and indicators. The post 34 has a lower end margin 38 and an upper end margin 40. The lower end margin 38 is connected to the base 22 via suitable fasteners (not shown) and is spaced forward of the forward roller 24 and generally adjacent the motor shroud 32. A support plate 42 is welded or otherwise secured to the upper end of the upper end margin 40 of the post. As shown in FIGS. 1, 4 and 5, the post 34 has an arcuately shaped bend extending from its lower end margin to its upper end margin. The bend of the post 34 has a concave surface portion 44 facing generally rearwardly and extending from the lower end margin 38 to the upper end margin 40. Preferably, the concave surface portion 44 extends from the lower end of the lower end margin 38 to the upper end of the upper end margin 40. The post 34 comprises a tube preferably having a polygonal cross-section, and more preferably having a generally rectangular cross-section as shown in FIG. 1. However, it is to be understood that the post 34 may have other cross-sectional shaped (e.g., circular, oval, etc.) without departing from the scope of this invention. The curvature of the post 34 is preferably such that at least part of the upper end margin 40 of the post 34 is positioned over (i.e., directly above) the forward roller 26.

Figure 3:
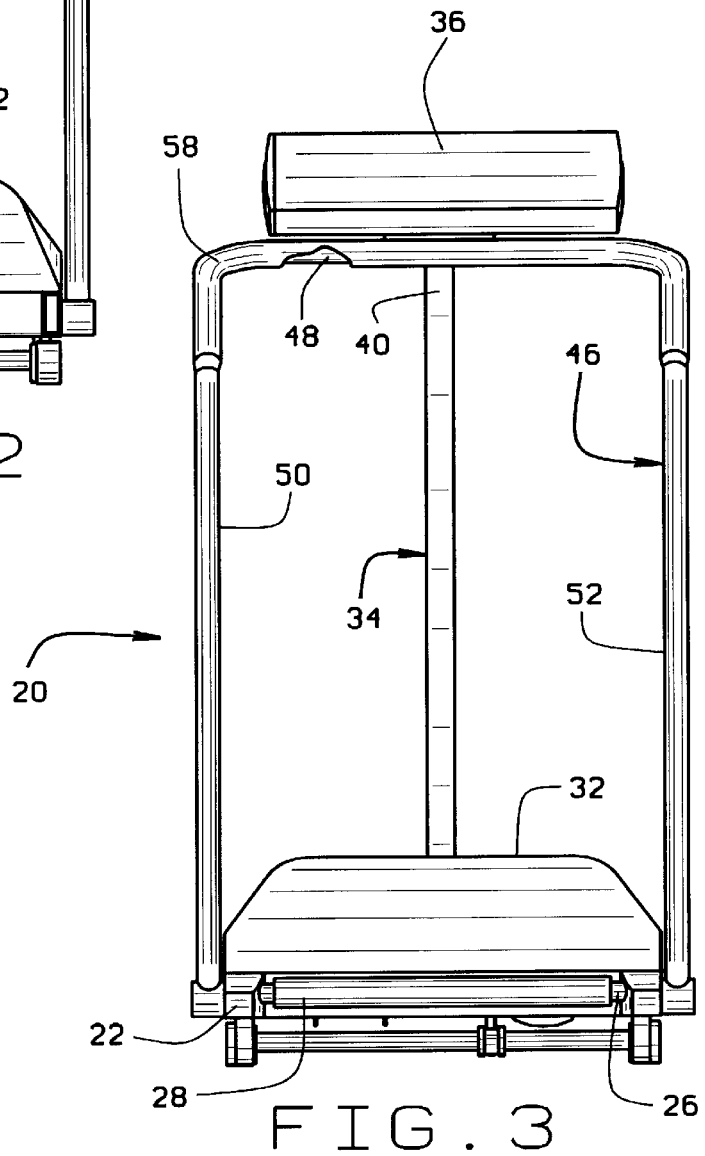
FIG. 3 is a front elevational view of the treadmill of FIG. 1 with portions broken away to show detail.

The treadmill 20 further includes a handle bar 46 having a central upper portion 48 (FIG. 3) and first (left) and second (right) side portions 50, 52. The upper portion 48 of the handle bar 46 is attached to the support plate 42 via a suitable threaded fastener (not shown). Thus, the upper portion 48 of the handle bar 46 is positioned generally adjacent the upper end margin 40 of the post 34. The side portions 50, 52 of the handle bar 46 extend from the upper portion 48 to the base 22 and have lower ends connected to the base on opposite sides of the upper reach 30 of the endless belt 28 and generally between the forward and rear rollers 24, 26 (i.e., forward of the rear roller and rearward of the forward roller). Each side portion 50, 52 of the handle bar 46 has an arcuately shaped bend 54, 56 (FIGS. 4 and 5) preferably extending at least three-fourths of the length of such side portion, and more preferably extending generally from the lower end of such side portion to the handle bar's upper portion 48. Preferably, the handle bar 46 constitutes a single monolithic piece. However, it is to be understood that the handle bar could be of several pieces without departing from the scope of this invention. Preferably, a hand grip 58 of a resilient polymeric material covers the upper portion 48 and at least parts of the side portions 50, 52.

For compact storage and shipping, the post 34 is preferably pivotally connected to the stationary base 22 for movement of the post between an upright position as shown in the Figures and a stowed position (not shown) in which the control panel 36 is positioned adjacent the upper reach 30 of the belt 28. Also, the handle bar 46 is pivotally connected at 60 to the base 22 for movement between an upright position (shown in the Figures) and a stowed position (not shown) in which the upper portion 48 of the handle bar is positioned forward of the motor shroud 32. When in their upright positions, the upper portion 48 of the handle bar 46 is secured via suitable fasteners to the support plate 42 so that the handle bar in part supports and stabilizes both the post 34 and control panel 36. The post 34 is further locked in its upright position by a suitable threaded fastener (not shown) connecting the lower end margin of the post to the stationary base. With the post 34 and handle bar 46 in their upright position, the treadmill 20 is ready for use by a runner or walker.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense. The invention therefore shall be limited solely by the scope of the claims set forth below.

What is claimed is:

1. A treadmill comprising:

a base;

a pair of spaced rollers journalled in the base, one of the rollers constituting a rear roller and the other roller constituting a forward roller spaced forward of the rear roller;

an endless belt entrained around the rollers, the endless belt including an upper reach extending between the rollers and adapted to enable a user to walk or run thereon;

a control panel;

a forward post configured for at least in part supporting the control panel, the post having a lower end margin and an upper end margin, the lower end margin being operatively connected to the base and spaced forward of the forward roller, the upper end margin being configured for supporting the control panel, the post having an arcuately shaped bend extending from its lower end margin to its upper end margin, the bend of the post having a concave surface portion facing generally rearwardly and extending from the lower end margin of the post to the upper end margin of the post, at least part of the upper end margin of the forward post being positioned directly above the forward roller.

2. A treadmill as set forth in claim 1 wherein the post comprises a tube with a polygonal cross-section.

3. A treadmill as set forth in claim 1 wherein the post comprises a tube with a generally rectangular cross-section.

4. A treadmill as set forth in claim 1 wherein the arcuately shaped bend of the post extends generally from the lower end of the post to the upper end of the post.

5. A treadmill as set forth in claim 1 wherein the concave surface portion extends generally from the lower end of the post to the upper end of the post.

6. A treadmill as set forth in claim 1 wherein the post is pivotally connected to the base for movement of the post between an upright position in which the concave surface portion faces generally rearwardly and a stowed position in which the control panel is positioned adjacent the upper reach of the belt.

7. A treadmill comprising:

a base;

a pair of spaced rollers journalled in the base, one of the rollers constituting a rear roller and the other roller constituting a forward roller spaced forward of the rear roller;

an endless belt entrained around the rollers, the endless belt including an upper reach extending between the rollers and adapted to enable a user to walk or run thereon;

a handle bar having an upper portion and first and second side portions, the upper portion being positioned above the upper reach of the endless belt, the side portions extending from the upper portion to the base and having lower ends operatively connected to the base on opposite sides of the upper reach and generally between the forward and rear rollers, each side portion of the handle bar having an arcuately shaped bend extending at least three-fourths of the length of such side portion.

8. A treadmill as set forth in claim 7 wherein the arcuately shaped bend of each side portion extends generally from the lower end of its corresponding side portion to the upper portion of the handle bar.

9. A treadmill as set forth in claim 7 further comprising a control panel generally adjacent the upper portion of the handle bar and supported at least in part by the handle bar.

10. A treadmill as set forth in claim 9 further comprising a forward post, the post having a lower end margin and an upper end margin, the lower end margin being operatively connected to the base and spaced forward of the forward roller, the control panel being supported at least in part by the post and being positioned generally adjacent the upper end margin of the post.

11. A treadmill as set forth in claim 10 wherein the post has an arcuately shaped bend extending from its lower end margin to its upper end margin.

12. A treadmill as set forth in claim 11 wherein the bend of the post has a concave surface portion facing generally rearwardly and extending from the lower end of the post to the upper end of the post.

13. A treadmill as set forth in claim 10 wherein the post is pivotally connected to the base for movement of the post between an upright and a stowed position in which the control panel is positioned adjacent the upper reach of the belt.

14. A treadmill as set forth in claim 13 wherein the handle bar is pivotally connected to the base for movement between an upright position and a stowed position in which the upper portion of the handle bar is positioned forward of the forward roller.

15. A treadmill comprising:

a base;

a pair of spaced rollers journalled in the base, one of the rollers constituting a rear roller and the other roller constituting a forward roller spaced forward of the rear roller;

an endless belt entrained around the rollers, the endless belt including an upper reach extending between the rollers and adapted to enable a user to walk or run thereon;

a control panel;

a forward post configured for at least in part supporting the control panel, the post having a lower end margin and an upper end margin, the lower end margin being operatively connected to the base and spaced forward of the forward roller, the upper end margin being configured for supporting the control panel, the post having an arcuately shaped bend extending from its lower end margin to its upper end margin, the bend of the post having a concave surface portion facing generally rearwardly and extending from the lower end margin of the post to the upper end margin of the post, at least part of the upper end margin of the forward post being positioned over the forward roller; and a handle bar having an upper portion and first and second side portions, the upper portion being positioned generally adjacent the upper end margin of the forward post, the side portions extending from the upper portion to the base and having lower ends operatively connected to the base on opposite sides of the upper reach of the endless belt and generally between the forward and rear rollers.

16. A treadmill as set forth in claim 15 wherein each side portion of the handle bar has an arcuately shaped bend extending generally from its lower end to the upper portion of the handle bar.

17. A treadmill as set forth in claim 15 wherein each side portion of the handle bar has an arcuately shaped bend extending at least three-fourths of the length of such side portion.

18. A treadmill as set forth in claim 17 wherein the upper portion and first and second side portions constitute a single monolithic piece.

* * * * *